US007597399B1

(12) United States Patent
Schneller

(10) Patent No.: US 7,597,399 B1
(45) Date of Patent: Oct. 6, 2009

(54) BRACKET FOR A STADIUM CHAIR

(76) Inventor: Lewis J. Schneller, 2019 W. Sussex Ave., Missoula, MT (US) 59801

( * ) Notice: Subject to any disclaimer, the term of this patent is extended or adjusted under 35 U.S.C. 154(b) by 485 days.

(21) Appl. No.: 11/416,340

(22) Filed: May 1, 2006

(51) Int. Cl.
*A47C 1/16* (2006.01)

(52) U.S. Cl. ..... 297/352; 297/252; 248/231.41; 248/231.71

(58) Field of Classification Search ..... 297/252, 297/352; 5/425, 428; 248/72, 228.3, 228.6, 248/229.1, 229.14, 229.25, 231.41, 231.71, 248/231.85
See application file for complete search history.

(56) References Cited

U.S. PATENT DOCUMENTS

| | | | | |
|---|---|---|---|---|
| 2,137,312 | A | 11/1938 | Thompson | |
| 2,195,955 | A * | 4/1940 | Hillenbrand | 248/72 |
| 2,480,310 | A | 8/1949 | Torrey | |
| 2,536,157 | A | 1/1951 | Campanelli | |
| 2,545,840 | A | 3/1951 | Browne | |
| 2,558,313 | A | 6/1951 | Pavey et al. | |
| 2,612,938 | A * | 10/1952 | Dawkins et al. | 297/352 |
| 2,754,891 | A * | 7/1956 | Barron | 297/352 |
| 2,792,875 | A * | 5/1957 | Pirrone | 297/252 |
| 5,335,385 | A * | 8/1994 | Brown | 5/662 |
| 5,533,219 | A | 7/1996 | Meyers | |
| 6,352,306 | B1 | 3/2002 | Dreiling | |
| 6,550,798 | B2 * | 4/2003 | MacKarvich | 248/229.14 |
| 6,719,370 | B2 | 4/2004 | Hannon et al. | |
| 6,926,360 | B2 | 8/2005 | Jones | |
| 7,316,452 | B2 * | 1/2008 | Vestweber | 297/252 |
| 2007/0018491 | A1 * | 1/2007 | Jones | 297/352 |

* cited by examiner

*Primary Examiner*—Peter R. Brown
(74) *Attorney, Agent, or Firm*—Jean Kyle

(57) ABSTRACT

A bracket affixes a stadium seat to a stadium bench without altering or modifying the bench. The bracket has an external piece and an internal piece. The external piece contacts the back of the bench seat and the horizontal shelf beneath the bench. The internal piece contact the inside surface of the back of the bench and the underside of the seating surface of the bench. The internal and external piece are connected to one another to lock the bracket in place.

6 Claims, 6 Drawing Sheets

BRACKET FOR A STADIUM CHAIR

BACKGROUND OF THE INVENTION

Stadium bench seating in ballparks and arenas is designed to maximize the number of spectators that can be seated in a limited area while providing each spectator with the best possible view of stadium activities. Most stadium seating however is not designed for comfort. Common bench seats have a hard, sometimes cold seating surface and provide no back support causing spectators to spend the game hunched over and uncomfortable.

A number of stadium seats have been described that are placed on a stadium bench to provide back support for stadium patrons. The most popular of these seats has a metal frame which supports a back and a seat cushion (U.S. Pat. No. 2,137,312). Hooked ends of the frame slip under the front bench seat to attach the seat to the bench. These seats however are not affixed to the bench. Unfortunately, the security and safety of both fans and players in a stadium setting has become an important issue. Many available stadium seats are easily removed from the bench and can be used as a weapon by angry fans or players. Stadiums and arenas are therefore requiring that stadium seats be affixed to stadium benches. Several systems by which to affix a stadium seat to a bench have been described (U.S. Pat. Nos. 2,480,310; 2,536,157; 2,545,840; 2,558,315; 5,533,219; 6,719,370 B2 and 6,926,360 B2). A system that bolts a stadium seat to the bench is described by Dreiling (U.S. Pat. No. 6,352,306 B1). Dreiling describes a clamp which is bolted to the stadium seat frame at the bend in the frame between the seat and the back. The bolt is driven into the back of the bench leaving an exposed bolt head at the rear of the bench which is not only accessible to someone seated in the tier above but can also snag a sock or shoe and injure someone passing in the tier above. Further, the stadium bench must be modified to accommodate the clamp of Dreiling.

Therefore, there remains a need for a simple, effective means to affix a stadium chair to a stadium bench. The means should not be readily accessible to stadium patrons, should preferably not alter the stadium bench and should be easy to install.

All patents, patent applications, provisional patent applications and publications referred to or cited herein, are incorporated by reference in their entirety to the extent they are not inconsistent with the teachings of the specification.

SUMMARY OF THE INVENTION

The subject invention is a bracket used to affix a stadium seat to a stadium bench. The bracket can be used with existing stadium seats or in combination with a specialized stadium seat. An external piece of the bracket contacts at least the back of the bench and curls under the bench past the bench edge. An internal piece of the bracket rests on the lip of the bench edge contacting the inside back of the bench and the underside of the bench seat. The internal and external pieces are connected to lock the bracket and seat to the bench.

In an alternative embodiment, the bracket is used in association with a specially designed stadium seat. The seat has a back frame secured to the external piece of the bracket. The frame supports the seat back. A seat cushion is also secured to the back frame. The external bracket piece and frame are secured to the bench when the internal bracket piece is fastened to the external piece.

DETAILED DESCRIPTION OF THE INVENTION

The bracket of the subject invention has an external piece which contacts the back and bottom shelf surface of the bench. The internal piece of the bracket rests on top of the lip of the shelf and contacts the inside back of the bench as well as the bottom of the bench seating surface. The internal and external pieces are connected to one another by a connecting means to form a bracket that stoutly secures a stadium seat to a stadium bench.

Aluminum stadium benches give the impression that the bench seat is a solid plank. The bench however is a shell of textured aluminum extruded in approximately 30 foot sections. The shell has a horizontal seating surface and front and back vertical sides. The front and the back vertical sides each have a horizontal shelf at the end of the side distal the seating surface which is reinforced by a lip. The shelf forms a bottom of the bench. A brace drops from the underside of the horizontal seating surface providing support along the length of the bench. Ribs (not shown) are arranged perpendicular to the bench surface approximately every 8 to 10 feet to provide the bench further support.

The bracket of the subject invention secures a stadium seat to one of these stadium benches. Stadium seats are typically made from a bended steel frame. The frame has a flat horizontal surface to form the top of the back of the seat. Each side of this horizontal surface is bent to form two vertical sides of the seat back. These sides are then bent horizontally, orthogonal to the seat top, to span the bench surface. The horizontal pieces are further bent as hooks that slide under the bench seat to secure the frame to the bench. These front-mounted stadium seats provide a cushioned seat and backrest. The backrest is formed from fabric tautly stretched between the sides of the frame to support the back of the seated person. The bracket of the subject invention can be used with these existing stadium seats to lock the seats to the bench providing a safe environment for both the players and fans. Preferably however the bracket includes its own frame to create a seat back providing a complete stadium seat.

Figure 1:
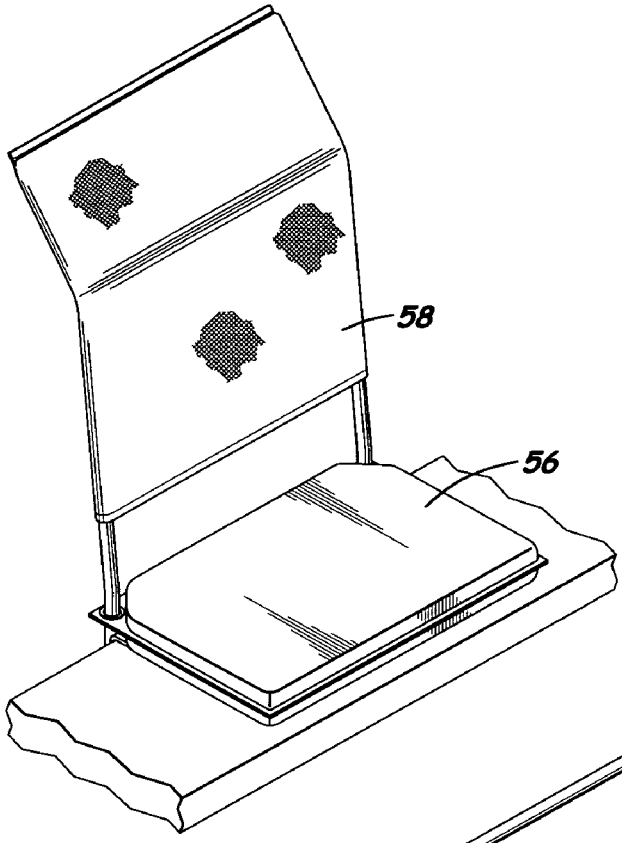
FIG. 1 is an environmental view of a preferred embodiment of the bracket of the subject invention.
Figure 2:
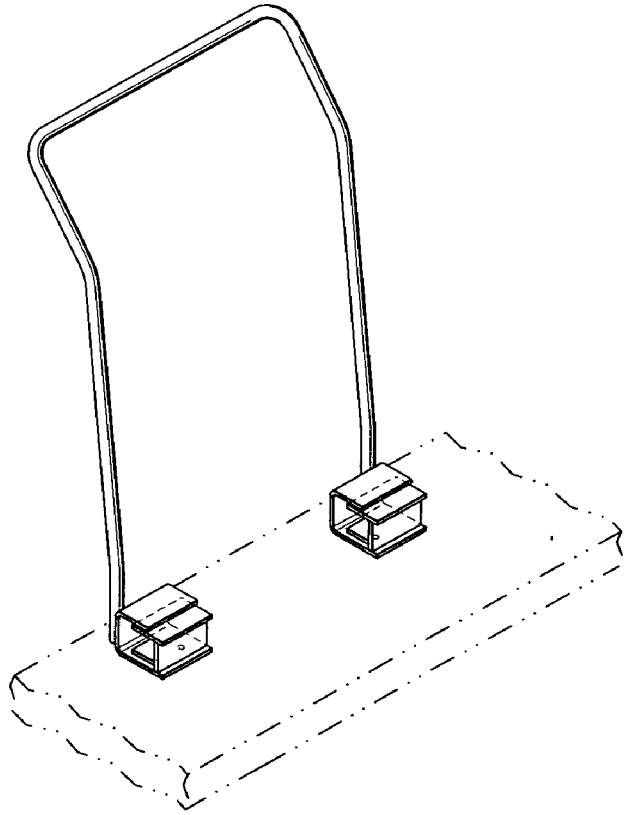
FIG. 2 is the environmental view shown in FIG. 1 with the bench in phantom showing the bracket attachment.

A preferred embodiment of the bracket of the subject invention is shown in FIG. 1. In this embodiment, the bracket includes a frame. The bracket is used to secure the seat to the stadium bench and is locked under the bench out of sight and out of reach of event spectators (FIG. 2).

Figure 3:
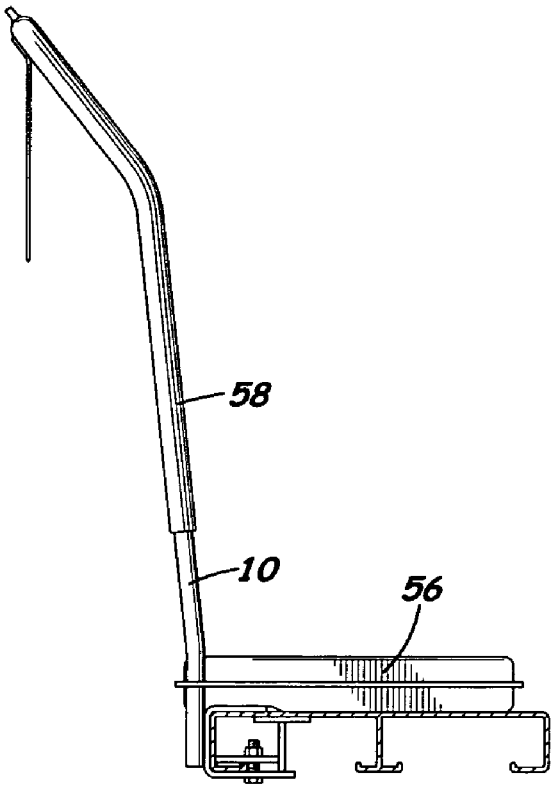
FIG. 3 is a side elevational view of a preferred embodiment of the bracket of the subject invention.
Figure 4:
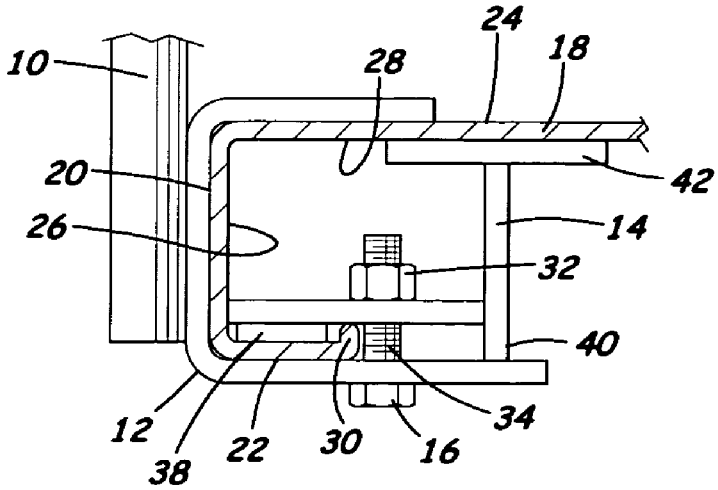
FIG. 4 is a fragmentary enlarged view of the bracket of FIG. 3 showing features not apparent in FIG. 3.

A preferred embodiment of the bracket of the subject invention is shown in detail in FIGS. 3 and 4. In this embodiment, the bracket comprises a frame 10 for a seat back. The bracket has an external piece 12 and an internal piece 14. The frame 10, typically a steel frame, is attached to the external piece 12 by welding. The bracket of the subject invention which forms its own stadium seat has an advantage over traditional stadium seats in that weakening bends in the frame of the seat are eliminated. Each time the seat frame is bent, it is weakened. The approximate 90° bend where the seat back bends to form the seat (see FIG. 11) is a weak point on the frame. By nature, a seated person will lean against the back of the seat stressing this weak point. On the stadium seat created by the bracket of the subject invention however this point of stress and weakness is eliminated. The back frame is welded directly to the vertical section of the external piece of the bracket. The weld is direct and strong. The 90° bend is eliminated and although it is preferred that the frame be bent outward slightly above the weld for comfort, this minimal bend does not weaken the frame.

Figure 8:
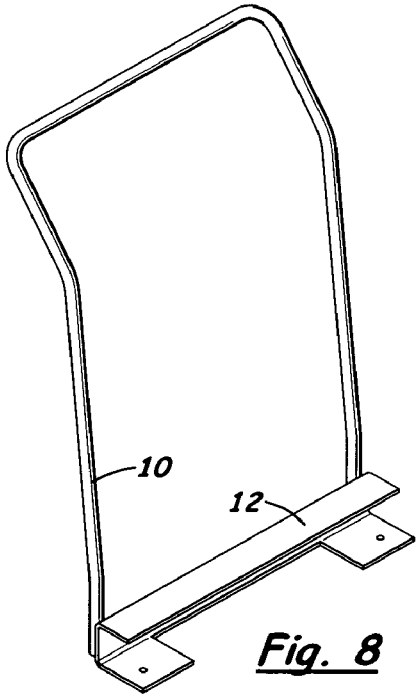
FIG. 8 is a perspective view of another preferred embodiment of an external piece of the bracket of the subject invention.

The bracket of the subject invention comprises an external piece 12 and an internal piece 14 that are connected through a connecting means 16 to one another to lock the stadium seat to the stadium bench 18. The external piece 12 of the bracket contacts at least the back of the bench 20 and its horizontal shelf 22. In the embodiment shown in FIG. 4, the external piece has a C-shape and further contacts the seating surface 24 of the bench. The external piece 12 of the bracket can be a single individual piece or a longer complete piece that spans the seat frame. Portions of the piece can be cut away (FIG. 8) to reduce the weight of the bracket.

Figure 5:
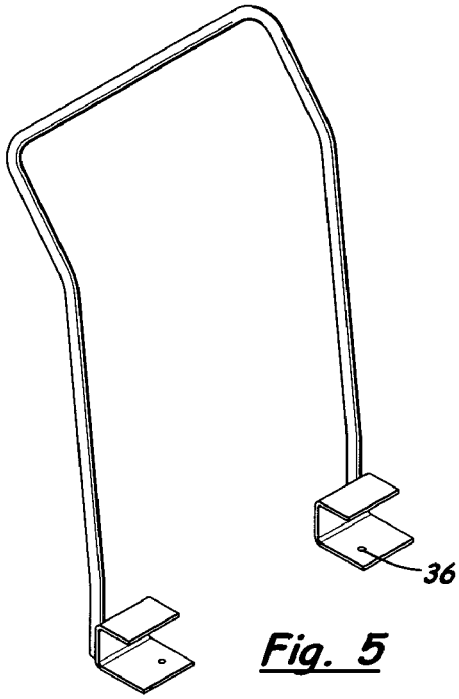
FIG. 5 is a perspective view of a preferred embodiment of an external piece of the bracket of the subject invention.
Figure 6:
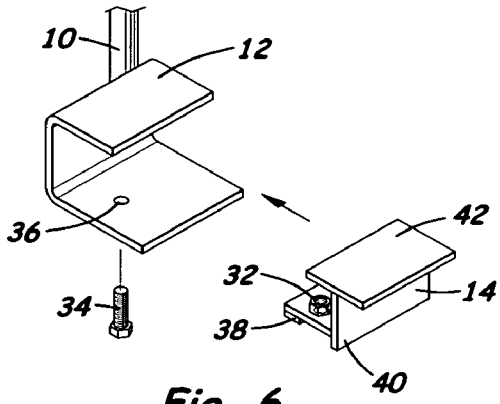
FIG. 6 is a fragmentary enlarged view of the bracket shown in FIG. 5 exploded to show the corresponding internal piece of the bracket and connecting means.
Figure 7:
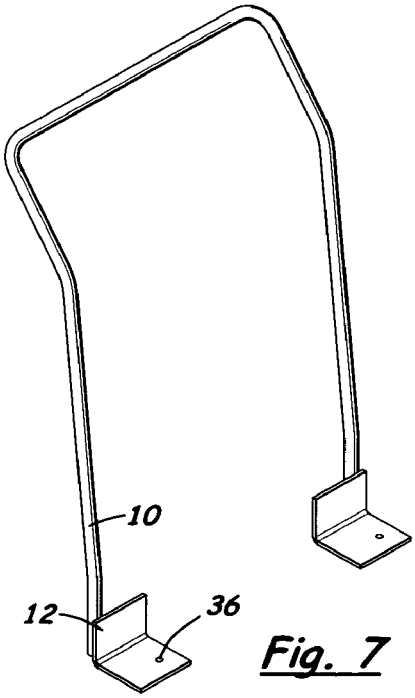
FIG. 7 a perspective view of another preferred embodiment of an external piece of the bracket of the subject invention.

As noted previously, the seat frame is welded directly to the external bracket piece. In the exemplified embodiment, the seat frame is welded on the outer edges of the external bracket piece (see FIGS. 5 and 7). In a stadium, the area designated for each spectator's seat is about 16-18 inches. To provide maximum back support, the width of the seat back is therefore generally about 16 inches. The frame is welded near the outside of the external piece so the stadium seats can be placed side by side. The frame however can be attached anywhere along the external piece and on either side of the external bracket piece.

The internal piece 14 of the bracket of the subject invention contacts the inside of the back of the bench 26 and the underside of the seating surface 28. The internal piece rests on the lip 30 of the horizontal shelf 22.

The external piece 12 and the internal piece 14 of the bracket of the subject invention are connected to one another by connecting means 16 to lock the stadium seat to the bench. Connection of the two pieces occurs under the bench seating surface out of reach of stadium patrons. In the exemplified embodiment, the connecting means is a nut 32 and a bolt 34. The nut 32 is welded to the top surface of the internal piece 14. The bolt is threaded through an aperture 36 in the external piece 12. The nut 32 guides the bolt and provides a positive hold. Welding or gluing the nut to the internal piece makes installation of the bracket on the stadium bench easier in that it requires the installer to align one less piece. A free nut can also be used with a bolt to connect the subject bracket pieces. Although a nut/bolt combination is exemplified as the connecting means of the subject invention any means which connects the external piece of the bracket to the internal piece of the bracket is suitable for use in the subject invention. For example, the pieces can be connected by merely threading a bolt through apertures in each piece or by devices including, but not limited to, cable ties, spring clamps and screw clamps.

In a particularly preferred embodiment, the bracket of the subject invention includes at least one shim. A lip shim 38 can rest between the inside of the horizontal shelf and the internal piece 14 of the bracket. The lip shim fills the space between the inside surface of the horizontal shelf and the internal bracket piece left by the lip. A shim 40 can also be provided to allow the internal piece to contact the external piece 12 opposite the underside of the seating surface 28. This shim prevents the internal piece from pivoting about the lip as it is fastened to the external piece stabilizing the secured bracket. In a further embodiment, a plate 42 is placed between the internal bracket 14 and the underside of the seating surface 28. This plate can accommodate variations in bench depth as well as serve to spread the force exerted by the internal piece across the undersurface of the bench. The bracket of the subject invention mounts a stadium chair to the rear of a stadium bench stoutly. The bracket exerts pressure on the bench in at least two directions at the same time. This multidirectional pressure provides the bracket a strong, steady hold.

Figure 13:
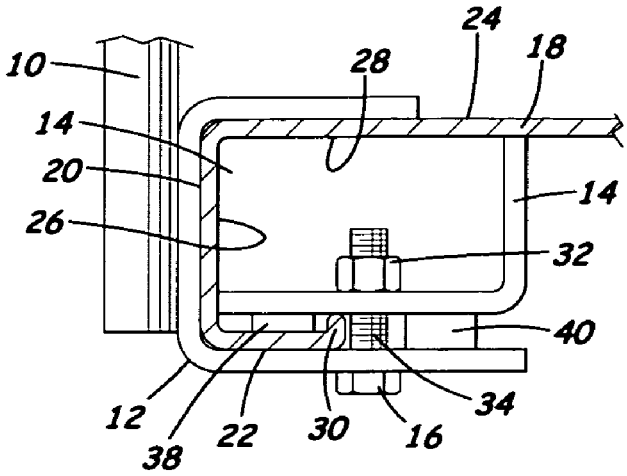
FIG. 13 is an enlarged fragmentary side elevational view of another preferred embodiment of the bracket of the subject invention on a bench.
Figure 14:
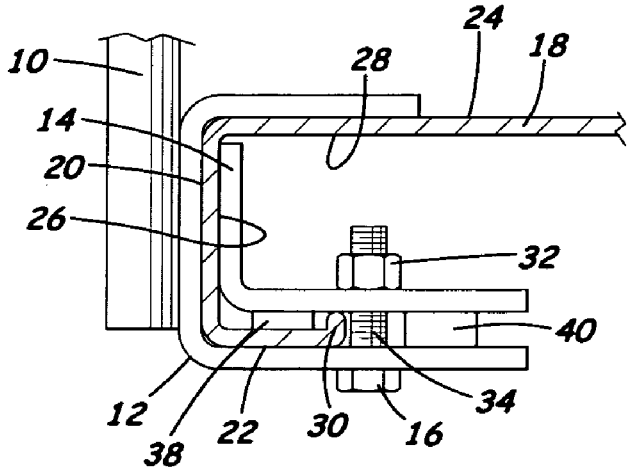
FIG. 14 is an enlarged fragmentary side elevational view of another preferred embodiment of the bracket of the subject invention on a bench.
Figure 15:
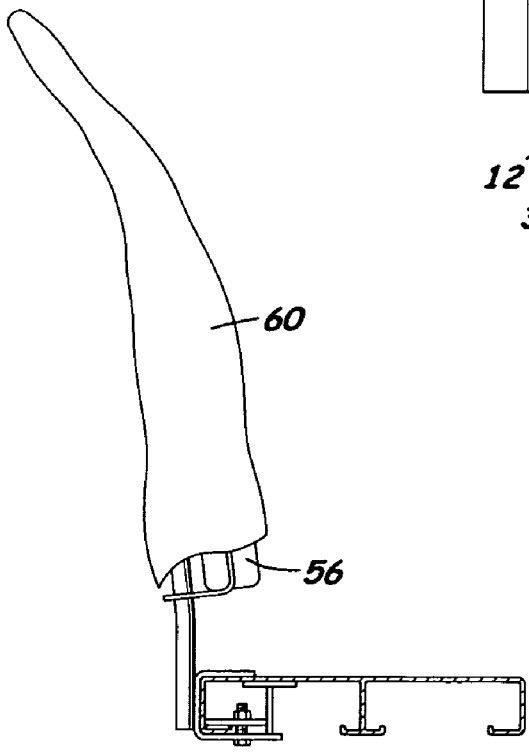
FIG. 15 is a side elevational view of a preferred embodiment of the bracket of the subject invention covered by the sleeve for storage.

The bracket pieces, portions of the bracket pieces, shims and plates can be an integral piece or separate items. For example, in the embodiment shown in FIG. 4, the external piece 12 is a C-shaped piece. The internal piece 14 is a combination of welded pieces. In this embodiment, the shims and plates are welded to form the internal bracket piece. Integrating the shims and plates with the internal bracket piece facilitates installation of the bracket on the stadium bench giving the installer less free pieces to handle. Independent shims and plates however allow the bracket to be custom fitted to benches made by various manufacturers. Further, it has been found that stock angle iron is convenient for use as both the internal and external bracket pieces (FIGS. 13 and 14). Using angle iron simplifies construction of the bracket pieces. FIGS. 13 and 14 show that angle iron is used effectively in creating both the internal and external pieces. Further, these FIGS. Show that the internal bracket which contacts the inside of the back of the bench and the underside of the seating surface of the bench can be positioned effectively in several ways.

Figure 9:
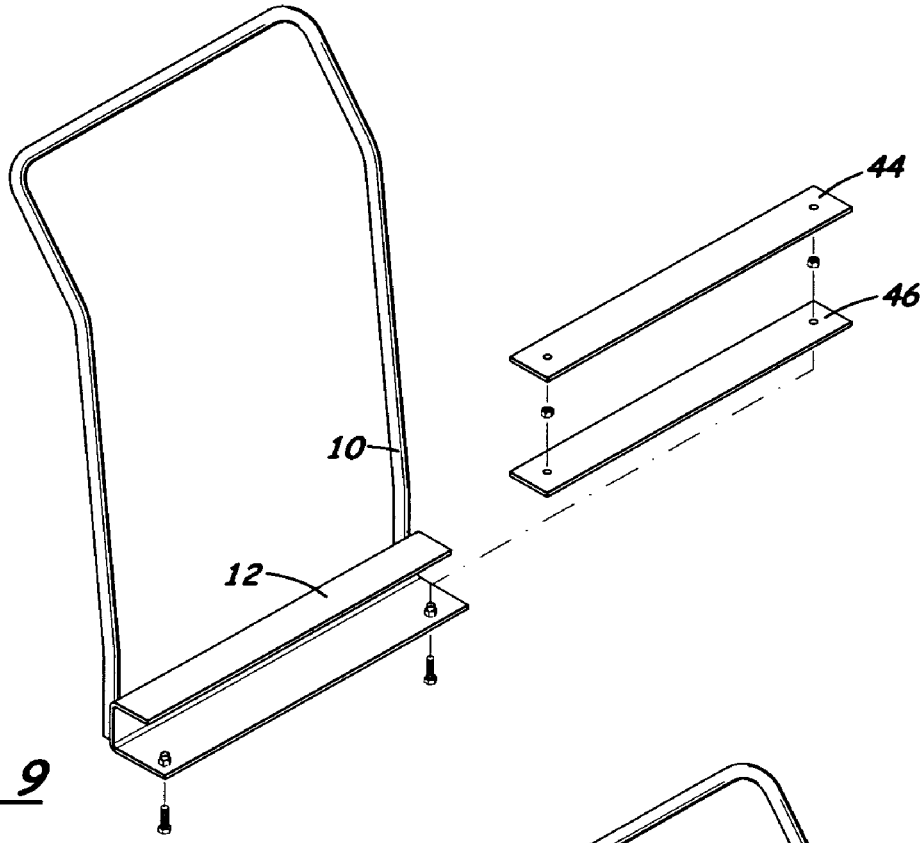
FIG. 9 is an exploded perspective view of another preferred embodiment of the bracket of the subject invention.
Figure 10:
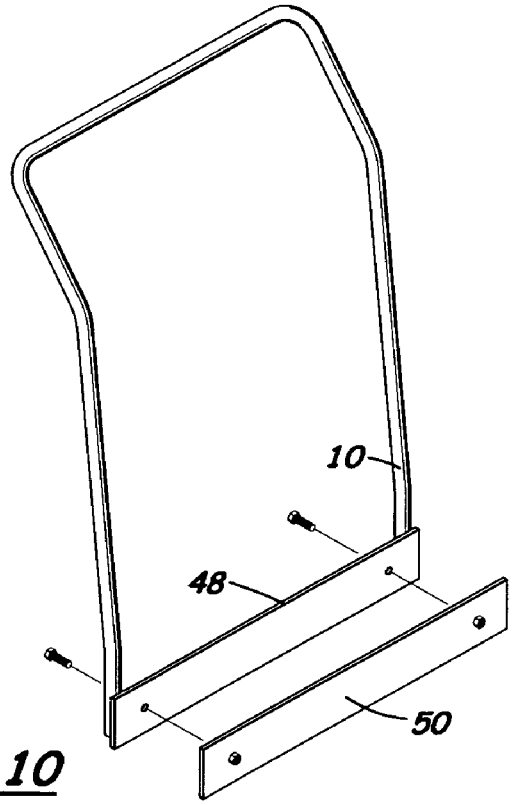
FIG. 10 is a perspective view of another preferred embodiment of the bracket of the subject invention.

FIGS. 9 and 10 show alternative embodiments of the bracket of the subject invention. FIG. 9 shows a C-shaped external bracket piece with a two piece internal bracket configuration. The internal bracket comprises an upper plate 44 and a lower plate 46. The lower plate 46 rests upon the lip 30 of the bench. The upper plate tightens against the underside of the seating surface 28. A lip shim and/or a shim against the underside of the seating surface will further stabilize the bracket. Nuts guide and secure the bolts that connect the external piece to the internal plates. FIG. 10 shows a simple embodiment of the bracket where the external piece is an external plate 48 which connects through the bench back 20 to an internal plate 50 with nuts and bolts. The plates in the embodiments shown in FIGS. 9 and 10 distribute the force of the bracket along the length of the plates providing a stout connection. The embodiment shown in FIG. 10 does require that the bench be modified by drilling holes into the back side of the bench.

Figures 11, 12:
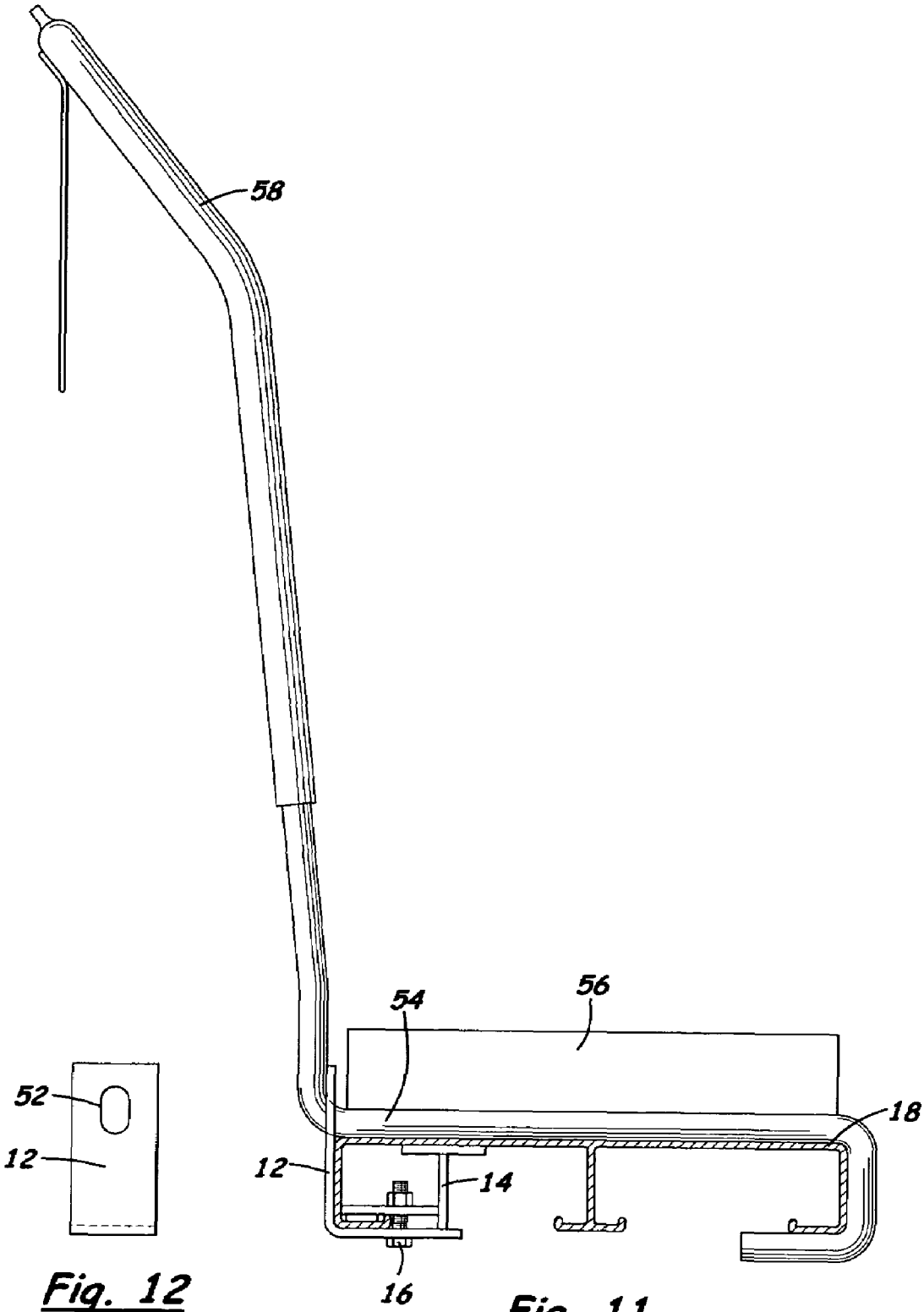
FIG. 11 is a side elevational view of another preferred embodiment of the bracket of the subject invention on an existing stadium seat.
FIG. 12 is a rear elevational view of the external piece of the bracket shown in FIG. 11.

The bracket of the subject invention can also be used to affix conventional stadium seats to stadium benches. In this embodiment, an irregular aperture 52 is provided in the portion of the external bracket that contacts the back of the bench 20 (FIG. 12). This irregular aperture 52 allows the external piece to be slipped over the frame 54 of the stadium seat. The external piece is set in place contacting the seat back 20 and horizontal shelf 22. The internal piece is slipped into place and the internal and external pieces are connected to one another to lock the seat to the bench.

The bracket of the subject invention allows stadium seats to be affixed to stadium benches. Stadium seats are preferred by both stadium managers and stadium patrons. The seats define the seating space allotted to each patron and prevent others from encroaching on that space. Affixing these seats to the benches at the beginning of the season reduces the staff necessary to dispense and receive seats before and after each game. Further, the necessity of storing the seats between game is eliminated. In a particularly preferred embodiment, the seat cushion 56 is attached to the frame with grommets. This allows the seat cushion to be pivoted up against the frame 10 so the seat cushion 56 and seat back 58 can be covered by a sleeve 60 for storage between games. Concerns for security in stadium and arena environments have caused athletic directors and stadium managers to require stadium seats be secured to stadium benches. The subject invention fulfills that need by not only providing an improved stadium seat but by allowing existing stadium seats to be locked to stadium benches.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A bracket which secures a stadium seat associated with the bracket to a stadium bench, the bench comprising a seating surface, a back extending from an edge of the seating surface and a bottom, wherein said bottom of the bench is formed by a horizontal shelf at an end of the back distal the seating surface the shelf reinforced by a lip along an edge of the shelf opposite the end of the back, the bracket comprising:

an external piece contacting an outer surface of at least the back of the bench and the bottom of the bench, wherein the external piece extends beyond the lip of the bottom of the bench;

an internal piece contacting an inner surface of the back of the bench and an underside of the seating surface of the bench wherein the internal piece extends beyond the lip of an inner surface of the bottom of the bench;

a first shim contacting an inner surface of the shelf near the lip and the internal piece to fill a space between the inner surface of the shelf and the internal piece caused by the lip;

a second shim positioned beyond the lip of the shelf contacting the internal piece and the external piece to fill a space between the internal piece and the external piece caused by the lip; and connecting means to connect the external piece to the internal piece beyond the lip locking the bracket and associated stadium seat to the bench.

2. The bracket of claim 1, wherein said stadium seat is associated with said bracket when a frame for a seat back is welded to said external piece.

3. The bracket of claim 2, wherein said first shim and said second shim are integral with said internal piece.

4. The bracket of claim 2, wherein said connecting means comprises a bolt threaded into an aperture positioned beyond said lip of said bottom of said bench in said external piece and through a corresponding aperture in said internal piece.

5. The bracket of claim 4, wherein said connecting means further comprises at least one nut.

6. The bracket of claim 5, wherein at least one of said at least one nuts is affixed to said internal piece.

* * * * *